United States Patent [19]

Schmidt et al.

[11] 4,381,924

[45] May 3, 1983

[54] PROCESS FOR SLUICING RESIDUES FROM THE PRESSURE SYSTEM OF A PRESSURE GASIFICATION TANK

[75] Inventors: Volkmar Schmidt, Oberhausen; Bernhard Lieder, Bottrop; Heinrich Scheve, Oberhausen; Hans Dohren, Krefeld, all of Fed. Rep. of Germany

[73] Assignee: Ruhrchemie Aktiengesellschaft, Oberhausen, Fed. Rep. of Germany

[21] Appl. No.: 245,778

[22] Filed: Mar. 20, 1981

Related U.S. Application Data

[63] Continuation of Ser. No. 53,884, Jul. 2, 1979, abandoned.

[30] Foreign Application Priority Data

Jul. 6, 1978 [DE] Fed. Rep. of Germany ..... 2829629

[51] Int. Cl.[3] ..... C10J 3/00

[52] U.S. Cl. ..... 48/197 R; 48/69; 48/DIG. 2; 406/124

[58] Field of Search ..... 48/206, 197 R, 202, 48/210, DIG. 2, 69; 406/109, 124, 126, 125; 414/217, 221; 110/171, 165 R; 55/55; 210/803, 800

[56] References Cited

U.S. PATENT DOCUMENTS

| | | | |
|---|---|---|---|
| 3,230,016 | 1/1966 | Gilbert et al. | 406/124 |
| 3,235,313 | 2/1966 | Waldhofer | 406/124 |
| 3,994,702 | 11/1976 | Schweimanns et al. | 48/206 |
| 4,018,588 | 4/1977 | Hardy, Jr. et al. | 48/206 |
| 4,067,623 | 1/1978 | Klein et al. | 406/124 |

*Primary Examiner*—William F. Smith

*Attorney, Agent, or Firm*—Sprung, Horn, Kramer & Woods

[57] ABSTRACT

An improvement in a process for periodically sluicing residues which are produced when gasifying ash-containing fuels with oxygen or an oxygen-containing composition under a pressure of 10 to 200 bars wherein ash is granulated in a water bath connected to a gasification chamber, suspended in water and passed into a non-pressurized collecting vessel provided with a conveyor is described. The improvement comprises:

a. discharging the residue from said water bath which is maintained in fluid communication with said gasification chamber via a lock vessel, said lock vessel being connected to a surge tank which contains water so that the lock vessel remains constantly filled with water;

b. equalizing the pressure between said lock vessel and said gasification chamber including said water bath by opening a connection to a process water feed line for said water bath and admitting water therein;

c. depressurizing said lock vessel and removing liberated gases (previously dissolved in the water) and steam therefrom by opening a connection between said lock vessel and said surge tank;

d. discharging suspended and granulated residues from said lock vessel into a collecting vessel by flushing said lock vessel with an adjustable amount of water flowing from said surge tank; and e. adjusting the water level in the collection vessel during the time the lock vessel is open so that the water level is sufficiently high such that no gas penetrates the lock vessel from the outside and the water level in the lock vessel does not sink.

3 Claims, 1 Drawing Figure

PROCESS FOR SLUICING RESIDUES FROM THE PRESSURE SYSTEM OF A PRESSURE GASIFICATION TANK

This is a continuation of application Ser. No. 53,884 filed July 2, 1979, now abandoned.

BACKGROUND OF THE INVENTION

1. Field of the Invention

The invention relates to a process and an apparatus for sluicing residues produced by gasification of ash-containing, especially solid, fuels such as coal, brown coal, lignite and other carbon-containing substances with oxygen or oxygen-containing compounds such as water and/or carbon dioxide. The reaction of the feedstock is carried out at a pressure of 10 to 200 bar. The gasification residues leave the gasification chamber in liquid or plastic state and are converted, in a water bath connected to the gasification chamber, into a solid granulate which may also be fine grained. The granular residues are periodically discharged from the pressure system of the pressure gasification plant by means of a lock vessel filled with water and arranged beneath the water bath.

2. Discussion of the Prior Art

Processes and apparatuses for sluicing the ash must meet a number of requirements. Apart from the fact that their operation must be possible with an economically justifiable expense, it must be ensured that the sluicing of the residue is effected safely and without polluting the environment. Thus, it is absolutely necessary that escape of production gas from the gasification chamber standing under high pressure into the atmosphere is avoided because of the risk of poisoning and explosion. Additionally, care is to be taken that hazardous gases or gases having an unpleasant odor which, for example, are dissolved in the process liquor under pressure and are liberated on depressurization as well as the waste water discharged with the slag do not enter the environment. Finally, the discharge of the granulated slag from the gasification chamber into the sluicing system should be interrupted only for a short time by the sluicing process to avoid backwash or damming up the slag in the gasification chamber and, consequently, blocking of the outlet.

A process for sluicing residues from a gasification chamber under elevated pressure is described in the German Offenlegungsschrift (DE-OS) No. 24 55 127 and involves substantially the use of a water bath for granulating the ash, a lock vessel and a conveyor. After disruption of the connection between the water bath and the lock vessel, the latter is depressurized via a pressure equalization vessel which is connected with the lock vessel and which previously, while the connection between the water bath and the lock vessel was open, had the same water level and, by means of an inert gas pad had also the same pressure as that in the water bath. While the lock vessel is emptied, inert gas under low pressure is introduced into the pressure equalization vessel and, after having emptied the lock vessel and interrupted the connection between the lock vessel and the conveyor, the lock system is again filled up with water and then brought again to the pressure of the gasification chamber by introducing to the pressure equalization vessel an inert gas which is under a higher pressure than that of the gasification chamber.

It is one disadvantage of this prior art process that the lock vessel must be filled up again with water for each operating cycle. This procedure is relatively time-consuming and requires a complicated pressure equalization system with inert gas. Moreover, gases liberated from the water of the lock vessel on depressurization are not prevented from entering the atmosphere.

It is an object of the invention to avoid the disadvantages described above.

SUMMARY OF THE INVENTION

This invention relates to an improved process for periodically sluicing residues which are produced when gasifying ash-containing, especially solid, fuels with oxygen or oxygen-containing compositions under a pressure of 10 to 200 bar, which ash is granulated in a water bath connected to the gasification chamber and suspended in water and passed into a non-pressurized collecting vessel provided with a conveyor. The improved mode of operation comprises A. discharging the residue from the water bath connected to the gasification chamber via a lock vessel, said lock vessel being connected to a surge tank which contains water so that the lock vessel remains constantly filled with water;

B. equalizing the pressure between the lock vessel and the gasification chamber including the water bath by opening a connection to a process water feed line for the water bath and admitting water therein;

C. depressurizing the lock vessel and removing liberated gases (previously dissolved in the water) and steam therein via the surge tank to a closed gas network by opening a connection between the lock vessel and the surge tank;

D. discharging the suspended and granulated residues from the lock vessel into a collecting vessel by means of the flushing action of an adjustable amount of water flowing from the surge tank; and E. adjusting the water level in the collecting vessel during the time the lock vessel is open sufficiently high such that no gas penetrates the lock vessel from the outside and the water level in the lock vessel does not sink.

It is an essential feature of the present invention that the lock vessel is constantly filled with water. i.e., also while the granulated residues are discharged, i.e., when the connection between the lock vessel and the gasification chamber is closed. This stage is reached when the lock vessel is connected to a surge tank situated at a higher level and filled with water and to a collecting vessel which is also filled with water and at atmospheric pressure so that, under normal conditions, neither gas nor steam is able to enter the lock vessel from the outside.

Sinking of the water level in the lock vessel perhaps due to gas or vapor being introduced indicates malfunction of the lock system and may be utilized by corresponding measuring devices for actuating shutoff devices between the gasification chamber and the lock vessel.

The solid residues granulated in the water bath sink by gravity automatically into the lock vessel during the filling period of the lock vessel. According to a particular embodiment of the invention, residues of very fine-granular consistency are conveyed from the water bath into the lock vessel by means of an injector. The injector is operated using the process water flowing into the water bath. It draws at least as much water from the lock vessel as is displaced by the residues entering the lock vessel.

During the sluicing period, after opening a shutoff device located between the lock vessel and the collecting vessel, the granulated residues present in the lock vessel sink from the lock vessel into the collecting vessel either solely due to their higher specific gravity compared to water or are flushed—by the fresh water flowing into the lock vessel together with the water of the lock vessel—into the surge tank by additional opening of a connecting pipe between the receiver and the lock vessel. It is of particular importance that, in the process according to the invention, the fresh water is passed from the surge tank into the lock vessel without gas or vapor being able to enter from the outside. The quantity of fresh water may be adjusted at will by controlling the shutoff device between the surge tank and the lock vessel and by observing the water level in the surge tank. In this manner one can assist the discharge of the residues from the lock vessel by a directed flushing action, compensate for the water consumption in the collecting vessel and, moreover, adjust the water in the lock vessel to a desired temperature.

Both clean tap water and cooled, purified and degassed recycle water from the scrubbing system of the gas produced in the gasification plant may be used as fresh water in the surge tank.

On the gas side, the surge tank is connected to a closed gas system which is maintained under constant, approximately atmospheric pressure or at slightly above atmospheric pressure.

The granulated residues which are periodically discharged from the lock vessel are passed into the water-filled collecting vessel which is operated at atmospheric pressure. The water level in this vessel is adjusted sufficiently high so that neither gas is able to penetrate from below into the lock vessel nor the lower-than-atmospheric pressure resulting in the upper part of the lock vessel becomes so high that the liquid column breaks, e.g., by formation of vapor. The granulated residues may be discharged from the collecting vessel in known manner either by means of mechanical conveyors (e.g., slag scapers, bucket conveyors, sieve conveyor belt) or hydraulically. In case of mechanical conveying, the amount of waste water is kept very small. When conveying hydraulically, the water is returned to the collecting vessel after settling of the residues.

In the collecting vessel, the different sedimentation behavior of the residual particles is utilized to separate fine solids in the gasification residues, a substantial part of which consists of carbonaceous constituents which have not been burnt in the gasification reaction, from the larger slag particles which settle rapidly in the water and to recirculate them to the gasification process.

The process according to the invention is carried out by means of a sluicing system which substantially consists of the lock vessel, the surge tank and the collecting vessel.

The lock vessel should be of such size that the number of discharge cycles per unit time is maintained low in order to sluice the slag produced safely in the gasification chamber. Not more than 8 to 12 discharge cycles per hour are desired.

The dimensions of the surge tank and collecting vessel should be selected such that safe operation is ensured even at the lowest water level.

The lock vessel is desirably suspended at the pressure vessel surrounding the gasification chamber in such a manner that the thermal expansions of both vessels occurring both with respect to each other and jointly with respect to the surrounding supporting structure do not lead to damage. Therefore, all connections are constructed elastically with compensators. As safeguard against uncontrolled actions of forces on fittings and connecting pipes, due to the considerable weight of the pressure-bearing structural parts, by thermal expansions or by external forces, the lock vessel and the pressure vessel surrounding the gasification chamber are connected flexibly so that the lock vessel may also be moved laterally. Additionally, the lock vessel may be connected to the pressure vessel by spring suspension. It is achieved in this manner that the weight of all suspended parts is fully supported also in case of thermal expansions and thus does not act on the fittings. The lateral guidance of the lock vessel in the supporting structure is constructed such that vertical expansion movements are possible.

Slide valves and, more preferably, ball valves with a large free cross-sectional area are used as shutoff devices between the slag-containing vessels. The ball valves may be constructed with smooth walls without corners, edges and dead spaces. The slag granules suspended in water may pass through them unchecked. The balls and seatings which are exposed to a particular high extent to the abrasive action of the slag are preferably provided with a wear-resistant armoring. The shutoff devices must also be suitable for operation at high water temperatures.

The driving mechanism of the shutoff devices is to be designed for the maximum differential pressure which may occur so that in case of trouble the shutoff devices are able to operate against the full gasification pressure. In normal sluicing operation, switching is effected almost at pressure balance.

For safety reasons, an additional shutoff device which is constantly open in normal sluicing operation is to be provided directly beneath the gasification chamber. It is provided with a completely separate reliable driving system and automatically shuts the gasification chamber in case of trouble.

BRIEF DESCRIPTION OF DRAWING

Referring to the annexed drawing, the same is a flow diagram, partially in section, showing an apparatus of the invention which carries out the process of the invention.

DESCRIPTION OF SPECIFIC EMBODIMENT

Figure 1:
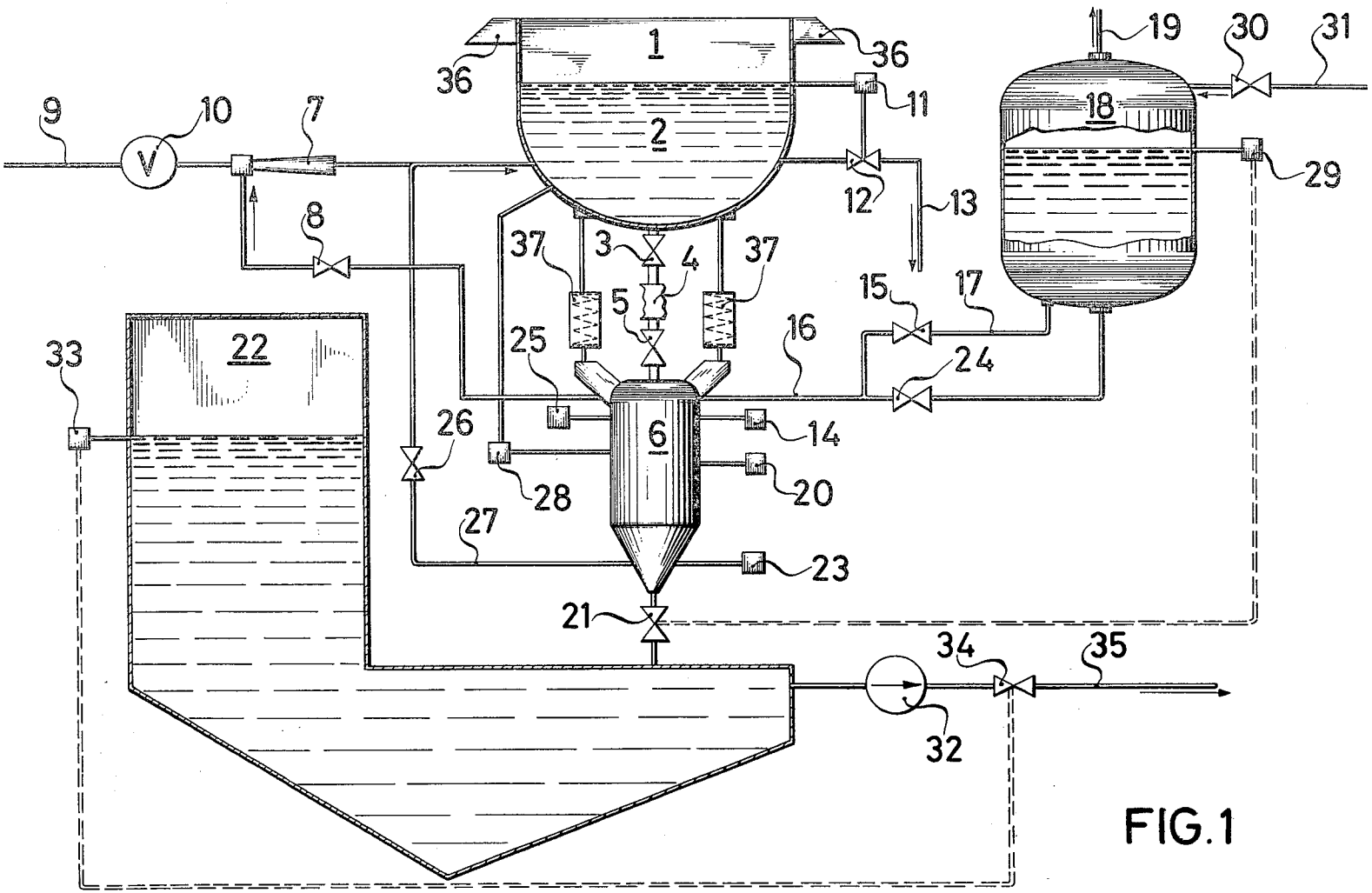

The process described above is carried out in accordance with the invention with the use of an apparatus which can consist of a gasification reactor having a gasification chamber 1 and a water bath 2 arranged immediately downstream of the gasification chamber which serves to granulate the residues. The same is supplied with process recycle water through line 9. The water bath is connected through a flexible junction 4 and shutoff devices 3 and 5 to a lock vessel 6 for the discharge of the granulated residues. The lock vessel 6 is connected via a shutoff device 21 with the collecting vessel 22 (for the granulated residues) and, via lines 16 and 17, with a surge tank 18.

The gasification residues produced in a gasification chamber 1 at pressures of, for example, 20 to 80 bar and at temperatures of 1100° to 1500° C. drop into a water bath 2 where they are granulated and, while being suspended in water, pass through a constantly open safety shutoff device 3, a flexible junction 4, e.g., a compensator, and an open shutoff device 5 into a lock vessel 6 which is under the same high pressure as the gasification chamber.

The water bath 2 has a high temperature of, for example, 180° C. which is dependent on the water vapor partial pressure in the synthesis gas in gasification chamber 1. To avoid the concentration of dissolved salts and fine-grained solid particles from the gasification residues in the water rising to an impermissibly high level, process recycle water is constantly fed via line 9 at a rate which is controllable by means of valve 10. A liquid level controller 11 maintains the water level constant by actuation of a control device 12 in a discharge line 13. Very fine-grained residues having poor sedimentation behavior may be withdrawn from the water bath 2 into the lock vessel 6 by means of the sucking action of an injector 7. The water withdrawn by the injector from the lock vessel is returned to the water bath 2 with the process waste water to function as driving medium for injector 7.

As soon as the lock vessel 6 is filled to the extent desired with the granulated residues or after the response of a filling level meter 14, the shutoff device 5 and, if necessary, a shutoff device 8 located before the injector 7 are closed and the lock vessel 6 is depressurized into a surge tank 18 via line 16 and by-pass line 17 by opening a pressure relief device 15. The surge tank is connected via line 19 with a closed gas system which is maintained at a constant slightly greater-than-atmospheric pressure of, for example, 500 to 2000 mm water column or at atmospheric pressure.

After the pressure drop in the lock vessel 6 has been indicated by a pressure gauge 20, a shutoff device 21 opens the lock vessel so that the granulated residues can sink into a water-filled non-pressurized collecting vessel 22. As soon as the slag has emerged from the lock vessel, which may, if desired, be indicated by a second filling level meter 23, a larger amount of fresh water may flow from the surge tank 18 into the lock vessel 6 through line 16 by opening an inlet device 24 of large dimensions for a short period of time. Residual slag which may have been caught is thus flushed into the collecting vessel 22, the water of the lock vessel thereby being heated by the slag.

In case of fine-grained gasification residues having poorer sedimentation behavior, one can also open the inlet device 24 before the shutoff device 21 is opened so that the full flushing effect of the water emerging from the surge tank is utilized for the discharge of the gasification residues. The rapid sinking of the water level in the surge tank 18 additionally indicates that the lock vessel 6 is free from residues. The surge tank 18 is prevented from running empty by a level controller 29 which causes the shutoff device 21 to close.

A filling level meter 25 at the top of the lock vessel 6 initiates alarm and shuts both shutoff devices 3 and 5 or blocks opening thereof if the water level in the lock vessel 6 drops in case of trouble or disturbances. When the injector 7 is in operation, vapor is formed during the depressurization process by the hot water entering the lock vessel 6. In this case, the water level in the lock vessel is to be kept constant by balancing the depressurization and the rate at which fresh water is supplied.

After sufficient fresh water has entered the lock vessel 6, the level controller 29 shuts the shutoff device 21. The pressure relief device 15 and the inlet device 24 are also shut. Pressure equalization of the lock vessel with the gasification chamber 1 is effected via line 27 connected to the process water line 9 by opening a pressure equalization valve 26. A differential pressure meter 28 indicates pressure equalization.

By opening the shutoff device 5, granulated residues suspended in water re-enter lock vessel 6 from the water bath 2.

The fresh water level having sunk in the surge tank 18 is brought to its original height by opening valve 30 in the feed line 31 in response to a further switching command from the level controller 29.

In the collecting vessel 22 which is at atmospheric pressure, the coarser slag particles introduced sink rapidly to the bottom while the settling velocity of the fine particles (which still contain carbon) is considerably lower. Therefore, these fine particles may be pumped off after a fixed period together with the excess water from the collecting vessel 22 by means of a waste water pump 32 and returned into the gasification process after passing a water treatment unit. The water level is again adjusted to the initial height by a level controller 33 by closing a shutoff device 34 in a discharge line 35. Only at this stage is the slag discharge device, which is of a conventional type and not represented in the drawing, e.g., a mechanical slag scraper, started. Its conveying capacity is designed such that the slag is removed from the collecting vessel in the time before the next discharge of the lock vessel.

Usually, the whole sluicing operation takes place automatically. Manual interventions are possible to prevent dangerous faulty switching.

The lock vessel 6 which is suspended by means of the flexible junction at the pressure vessel enclosing the gasification chamber 1 can be moved, the pressure vessel in turn resting with a plurality of claws 36 in the supporting structure. The weight of all suspended structural parts is borne by springs 37 and, therefore, does not act on the fittings 3, 4, and 5.

What is claimed is:

1. In a process for periodically sluicing residues which are produced from gasifying ash-containing fuels with oxygen or an oxygen-containing composition under a pressure of 10 to 200 bars wherein ash is granulated in a water bath connected to a gasification chamber, suspended in water and passed into a non-pressurized collecting vessel, the improvement which comprises:

A. Discharging the residue from said water bath, which is maintained in fluid communication with said gasification chamber, to a lock vessel, said lock vessel being connected to a process water feed line through which process water flows to said water bath by a normally closed pressure equalizing line, said lock vessel being connected to a surge tank which contains water so that the lock vessel remains constantly filled with water, B. Periodically interrupting said discharging of residue into the lock vessel and depressuring said lock vessel during said interruption and removing liberated gases (previously dissolved in the water) and steam therefrom by opening a connection between said lock vessel and said surge tank, C. Discharging suspended and granulated residues from said depressurized lock vessel into a pressureless collecting vessel by flushing said depressurized lock vessel with an adjustable amount of water flowing from said surge tank, D. Adjusting the water level in the collecting vessel during the time the depressurized lock vessel is open so that the water level is sufficiently high such that no gas penetrates the depressurized lock vessel from the outside and the water level in the depressurized lock vessel does not sink, and then E. Resuming the discharging of the residue by equalizing the pressure between said lock vessel, and said water bath by opening said normally closed pressure equalizing line and admitting water therein.

2. A process according to claim 1 wherein the residues are conveyed from the water bath into the lock vessel by means of an injector which creates a sucking action by withdrawing water from the lock vessel and discharging the water into said water bath.

3. A process according to claim 2 wherein said injector is disposed in said process water feed line so that the passage of process water through said feed line and said injector creates the sucking action.

* * * * *